US005166469A

United States Patent [19]

Kerdraon et al.

[11] Patent Number: 5,166,469

[45] Date of Patent: Nov. 24, 1992

[54] DELAY FUSE FOR SEQUENTIALLY DETONATING SHAPED CHARGES

[75] Inventors: Alain L. Kerdraon, Bourges; Richard J. C. Durand, Gramat, both of France

[73] Assignee: GIAT Industries, France

[21] Appl. No.: 768,904

[22] PCT Filed: Mar. 29, 1991

[86] PCT No.: PCT/FR91/00251

§ 371 Date: Oct. 21, 1991

§ 102(e) Date: Oct. 21, 1991

[87] PCT Pub. No.: WO91/14917

PCT Pub. Date: Oct. 3, 1991

[30] Foreign Application Priority Data

Mar. 29, 1990 [FR] France ..... 90 03998

[51] Int. Cl.[5] ..... F42B 12/18; F42C 11/02

[52] U.S. Cl. ..... 102/210; 102/204; 102/308; 102/476

[58] Field of Search ..... 102/276, 266, 204, 210, 102/217, 222, 476, 308

[56] References Cited

U.S. PATENT DOCUMENTS

| | | | |
|---|---|---|---|
| 2,894,457 | 7/1959 | Severance | 102/204 |
| 3,349,709 | 10/1967 | Vilbajo | 102/210 |
| 3,356,026 | 12/1967 | Lubig | 102/210 |
| 3,967,141 | 6/1976 | Gawlick et al. | 102/210 |
| 4,714,022 | 12/1987 | Chaumeau et al. | 102/476 |
| 4,793,256 | 12/1988 | Webb | 102/210 |
| 4,803,928 | 2/1989 | Kramer et al. | 102/476 |
| 4,854,240 | 8/1989 | Hirsch et al. | 102/476 |
| 5,003,879 | 4/1991 | Jones | 102/204 |

FOREIGN PATENT DOCUMENTS

| | | |
|---|---|---|
| 652466 | 12/1964 | Belgium . |
| 2559896 | 8/1985 | France . |

*Primary Examiner*—David H. Brown

*Attorney, Agent, or Firm*—Parkhurst, Wendel & Rossi

[57] ABSTRACT

A delay fuse for a warhead (1) including at least two charges (3, 8) for sequential detonation disposed inside a casing (2). The delay fuse comprises a screen (6) movable in a longitudinal axial direction inside the casing (2) and under the effect of the first charge detonating, from a starting position to a destination position in which it acts on control means (12) for firing a second charge. The fuse includes a component of compressible material (13) disposed inside the casing between the screen (6) and the control means (12). The invention is applicable to shells, rockets, or missiles.

9 Claims, 1 Drawing Sheet

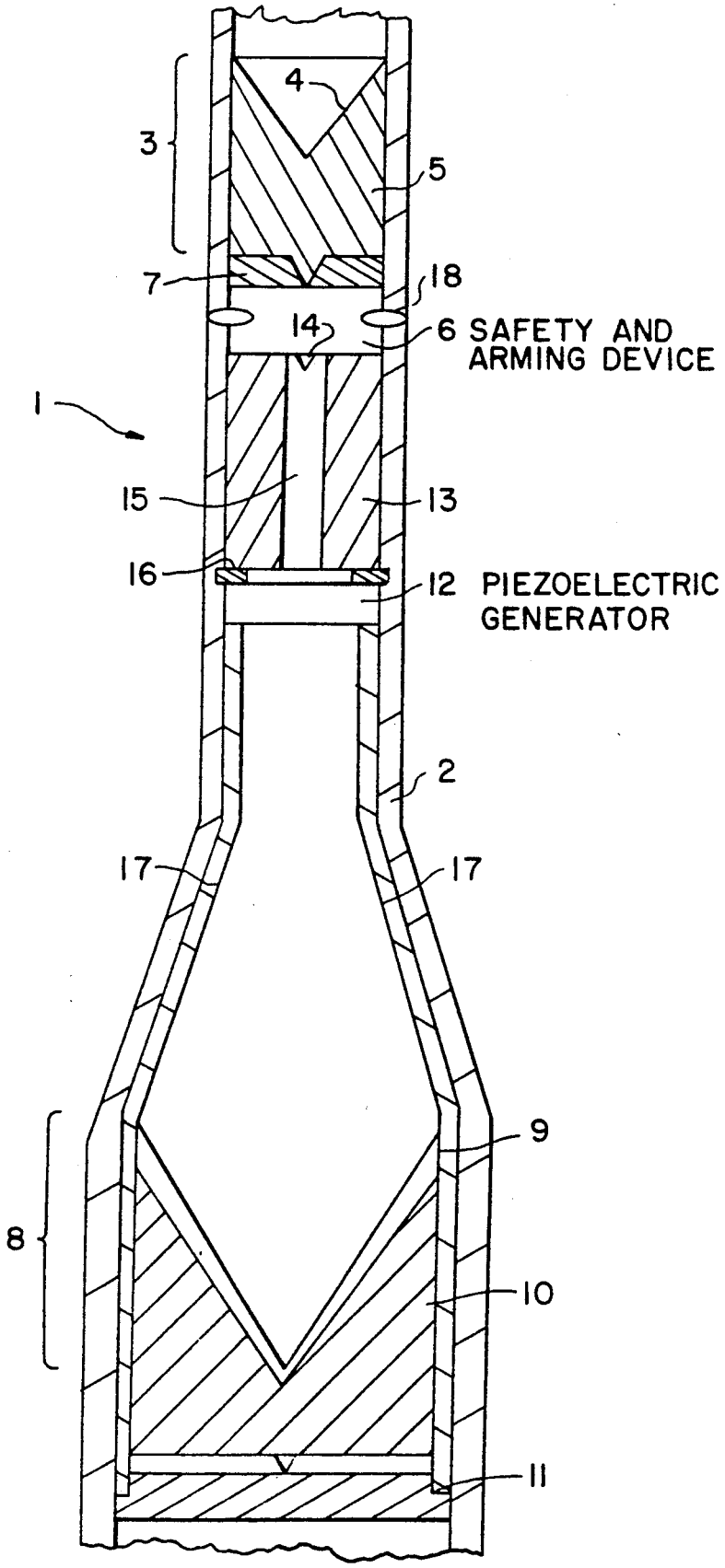
4
3
5
7
18
14
6 SAFETY AND ARMING DEVICE
1
15
13
16
12 PIEZOELECTRIC GENERATOR
2
17
17
9
8
10
11

DELAY FUSE FOR SEQUENTIALLY DETONATING SHAPED CHARGES

BACKGROUND OF THE INVENTION

The present invention relates to a delay fuse for placing between two shaped charges mounted in tandem in a warhead.

French patent FR 2 559 896 describes a delay fuse including an inter-charge protective screen.

On detonation of the front charge in the warhead, the protective screen moves rearwards and causes an electrical circuit to be closed.

Such a configuration makes it possible to obtain considerable delays (of 0.5 milliseconds (ms) to 3 ms) while avoiding the need to use a conventional solution with coils of great lengths of fuse cord.

However, when using this solution, even the slightest change in the required time delay requires a change in the total mass of the screen, or in the distance the screen is to travel.

Such geometrical modifications are particularly difficult to perform since they give rise to changes in the dimensions of the warhead and also in the distribution of its total mass.

In addition, long delays require long travel distances thus degrading the compactness of the warhead.

SUMMARY OF THE INVENTION

An object of the present invention is to provide a delay fuse between two shaped charges mounted in tandem that enables time delay changes without disturbing the geometrical and ballistic characteristics of the warhead.

Another object of the present invention is to make it possible to reduce the distance between shaped charges that are to be detonated in sequence without thereby reducing the firing time delay between these charges.

The invention thus provides a delay fuse for a warhead including at least two charges for sequential detonation disposed inside a casing, the delay fuse comprising a screen which is axially movable inside the casing under the effect of the first charge detonating, from a starting position to a destination position wherein it acts on control means for firing a second charge, which fuse is characterized in that it includes a component of compressible material disposed inside the casing between the screen and the control means.

The screen may be fixed to the casing by shearable fixing means. The crushing strength of the compressible material is such that its volume reduces by less than 5% when it is subjected to a pressure equal to the quotient of the inertia, from warhead launch, of the assembly constituted by the first charge and the screen divided by the cross-sectional area of the first charge.

The crushing strength of the compressible material is preferably such that its volume reduces by less than 5% under a pressure of $10^6$ pascals, and that it reduces by at least 90% under a pressure of $10^8$ pascals.

Advantageously, the compressible material is an organic foam having a density of not more than 250 kg/m$^3$, e.g. a polyethylene foam or a polyurethane foam.

The screen may be constituted by a safety and arming device for the first charge, and the screen may be separated from the first charge by a shock-absorbing block.

The shock-absorbing block is partly made of a sintered metal material of density lying in the range 1500 kg/m$^3$ to 3000 kg/m$^3$.

The means for controlling firing of the second charge may include a piezoelectric generator.

Other advantages of the invention appear from reading the following description of a particular embodiment, which description is made with reference to the accompanying drawing which is a diagram of a delay fuse in accordance with the invention.

BRIEF DESCRIPTION OF THE DRAWING

With reference to the accompanying figure, a fragment of a warhead 1 is shown diagrammatically.

It includes two shaped charges mounted in tandem inside a casing 2 for sequential firing.

DETAILED DESCRIPTION OF A PREFERRED EMBODIMENT

The front charge 3 is fired first in convention manner and comprises a covering 4 and an explosive filler 5. A detection system (not shown) fires it by means of a safety and arming device 6.

FIG. 1 shows a partial cross-section of a warhead according to the present invention.

A shock-absorbing block 7 is disposed between the filler 5 and the safety and arming device 6. It is designed to protect said device from the effect of the front charge 3 exploding. It is preferably made of a sintered metal material of density lying in the range 1,500 to 3,000 kg/m$^3$, e.g. sintered iron.

The rear charge 8 is shown in this case as being of larger calibre than the front charge and it comprises a covering 9 and an explosive filler 10.

A second safety and arming device 11 serves to fire the rear charge, and it is connected by conductors 17 to firing control means constituted, in this case, by a piezoelectric generator 12.

The first safety and arming device 6 acts as a protective screen for the rear charge and it is kept separate from the piezoelectric generator 12 by a component 13 made of compressible material.

In a manner analogous to that described in French patent FR 2 559 896, the screen is projected towards the rear of the warhead by the front charge detonating.

The function of the screen is to act on the control means so as to cause the rear charge to be fired after a certain time interval.

The function of the compressible component is to absorb a portion of the kinetic energy of the screen by deforming.

This makes it possible firstly to damp the effects on the rear charge due to the front charge detonating, and secondly to increase the time taken by the screen to act on the control means, for given screen mass, compared with a delay configuration in which no compressible component is provided.

It is thus possible to obtain longer delays with a shorter inter-charge distance, for example, for a 200 ms delay, the invention makes it possible to obtain a saving of 5% of 20% in the inter-charge distance (depending on the hardness of the foam).

Depending on the mechanical and geometrical characteristics of the component made of compressible material, the screen may act directly on the control means after said compressible element has been completely or partially crushed, or else it may act on the control means indirectly via a certain residual thickness of the compressible component.

For example, it is possible to provide a screen that carries a projecting portion 14 which is received in an axial cylindrical bore 15 of the compressible component.

This projecting portion 14 acts on control means of the type disclosed in patent FR 2 555 896, e.g. coils, a piezoelectric generator, or by closing an electrical contact.

A retaining washer 16 may be disposed between the compressible element and the control means in order to isolate the control means from the forces generated by the compressible element while the screen is moving, which makes it possible to avoid premature firing of the rear charge when using a piezoelectric generator.

The compressible element is preferably selected so as to have crushing strength such that its volume reduces by less than 5% when it is subjected, on warhead launch, to a pressure equal to the quotient of the inertia of the assembly comprising the first charge and the screen divided by the cross-sectional area of the first charge.

The compressible component can then be used as a retaining component capable of withstanding the inertia of the assembly constituted by the front charge and its safety and arming device when the warhead is launched (for an acceleration of less than 1000 $m/s^2$).

In most cases, it suffices to select a material whose volume reduces by less than 5% under a pressure of $10^6$ pascals and whose volume reduces by at least 90% under a pressure of $10^8$ pascals.

Full satisfaction can be obtained with organic foams of density no greater than 250 $kg/m^3$, such as polyethylene foams or polyurethane foams.

Under high acceleration (greater than 1000 $m/s^2$), it is possible to provide means for fixing the screen to the casing 2, e.g. an adhesive or else pins 18 that shear when the front charge detonates.

We claim:

1. A delay fuse for a warhead including a casing and at least a first charge and a second charge longitudinally axially disposed apart from each other inside said casing, comprising:

control means disposed within said casing for firing said second charge;

a movable screen disposed in said casing axially movable from a starting position to a detonating position to prompt said control means to initiate firing of said second charge; and compressible material disposed within said casing between said movable screen at said starting position and said control means.

2. The device of claim 1, further comprising shearable fixing means to fix said screen to said casing.

3. The device of claim 1, wherein said compressible material has a crushing strength such that volume of said compressible material is reduced by not more than 5% under a pressure of $10^6$ Pa, and is reduced by at least 90% under a pressure of $10^8$ Pa.

4. The device of claim 1, wherein said screen is defined by a safety and arming device.

5. The device of claim 1, wherein said control means is defined by a piezoelectric generator.

6. The device of claim 1, wherein said compressible material is an organic foam having a density of not greater than 250 $kg/m^3$.

7. The device of claim 6, wherein said organic foam comprises at least one material selected from the group consisting of polyethylene foam and polyurethane foam.

8. The device of claim 1, further comprising a shock-absorbing block disposed between said screen and said first charge.

9. The device of claim 8, wherein said shock-absorbing block is made of sintered metal having a density between 1500 $kg/m^3$ and 3000 $kg/m^3$.

* * * * *